US011597222B2

(12) United States Patent
Mano et al.

(10) Patent No.: US 11,597,222 B2
(45) Date of Patent: Mar. 7, 2023

(54) PRINTING HEAD HEIGHT CONTROL

(71) Applicant: Kornit Digital Ltd., Rosh HaAyin (IL)

(72) Inventors: Ilan Shmuel Mano, Ramat-Gan (IL); Efraim Yohanani Naftali, Rishon-LeZion (IL); Yinnon Books, Tel-Aviv (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 16/903,403

(22) Filed: Jun. 17, 2020

(65) Prior Publication Data

US 2020/0307285 A1 Oct. 1, 2020

Related U.S. Application Data

(63) Continuation of application No. PCT/IL2019/051389, filed on Dec. 19, 2019.

(60) Provisional application No. 62/782,353, filed on Dec. 20, 2018.

(51) Int. Cl.
*B41J 3/407* (2006.01)
*B41J 25/308* (2006.01)

(52) U.S. Cl.
CPC ..... *B41J 25/3082* (2013.01); *B41J 3/4078* (2013.01)

(58) Field of Classification Search
None
See application file for complete search history.

(56) References Cited

U.S. PATENT DOCUMENTS

| | | | | |
|---|---|---|---|---|
| D336,479 | S | 6/1993 | Shuji Shinagawa et al. | |
| D357,484 | S | 4/1995 | Montague et al. | |
| 5,505,129 | A * | 4/1996 | Greb | B65H 23/0216 101/151 |
| 5,506,607 | A | 4/1996 | Sanders, Jr et al. | |
| 5,740,051 | A | 4/1998 | Sanders, Jr. et al. | |
| 6,163,329 | A | 12/2000 | Venkataraman et al. | |
| 6,229,556 | B1 | 5/2001 | Venkataraman | |
| 7,607,745 | B2 | 10/2009 | Ben-Zur | |
| D614,233 | S | 4/2010 | Kemmochi et al. | |
| D619,166 | S | 7/2010 | Ishizawa et al. | |

(Continued)

FOREIGN PATENT DOCUMENTS

| | | |
|---|---|---|
| CN | 101121343 | 2/2008 |
| CN | 101830117 | 9/2010 |

(Continued)

OTHER PUBLICATIONS

International Search Report and the Written Opinion dated Mar. 24, 2020 From the International Searching Authority Re. Application No. PCT/IL2019/051389. (11 Pages).

(Continued)

*Primary Examiner* — Erica S Lin

(57) ABSTRACT

Apparatus and method for digital printing comprises placing a medium to be printed on a print table and feeding towards a print head. A finite length of the medium approaching the print head is measured for variations in thickness towards the print head. Then, the height of the print head is adjusted to maintain a predetermined printing distance. Subsequently, if the extent reaches or exceeds the printing distance then it is assumed that wrinkles are present and printing is paused for readjustment of the medium, which may be a textile and more particularly a garment.

14 Claims, 7 Drawing Sheets

(56) References Cited

U.S. PATENT DOCUMENTS

| | | | | |
|---|---|---|---|---|
| D638,449 | S | 5/2011 | Schindler et al. | |
| D640,737 | S | 6/2011 | Tsuruta et al. | |
| D676,881 | S | 2/2013 | Mueller | |
| D676,882 | S | 2/2013 | Mueller | |
| D680,115 | S | 4/2013 | Kasai | |
| D690,744 | S | 10/2013 | Koide et al. | |
| D690,745 | S | 10/2013 | Koide et al. | |
| D696,315 | S | 12/2013 | Schmid | |
| D726,789 | S | 4/2015 | Schmid | |
| D742,451 | S | 11/2015 | Landa et al. | |
| D763,957 | S | 8/2016 | Kohno et al. | |
| 9,751,312 | B1 | 3/2017 | Valancy et al. | |
| D875,826 | S | 2/2020 | Zanzotti | |
| D875,827 | S | 2/2020 | Zanzotti | |
| 2002/0024544 | A1 | 2/2002 | Codos | |
| 2003/0043246 | A1 | 3/2003 | Codos | |
| 2004/0003738 | A1 | 1/2004 | Imiolek et al. | |
| 2004/0017456 | A1 | 1/2004 | Obertegger et al. | |
| 2005/0156078 | A1* | 7/2005 | Ragard | B65H 19/2261 242/534 |
| 2005/0195229 | A1 | 9/2005 | Barss | |
| 2005/0206711 | A1* | 9/2005 | Milini | B41J 11/002 347/104 |
| 2008/0192075 | A1* | 8/2008 | Campion | B41J 3/28 347/104 |
| 2009/0295895 | A1* | 12/2009 | Weingartner | B41J 11/007 347/104 |
| 2010/0171782 | A1* | 7/2010 | Kado | B41J 11/0085 347/16 |
| 2013/0000830 | A1 | 1/2013 | Green | |
| 2013/0050328 | A1 | 2/2013 | Yanagishita | |
| 2013/0076812 | A1 | 3/2013 | Kanaya et al. | |
| 2013/0076814 | A1 | 3/2013 | Kanaya et al. | |
| 2013/0278694 | A1 | 10/2013 | Takeuchi et al. | |
| 2013/0278695 | A1 | 10/2013 | Yanagishita et al. | |
| 2013/0278697 | A1 | 10/2013 | Takeuchi et al. | |
| 2013/0278698 | A1 | 10/2013 | Takeuchi et al. | |
| 2013/0293605 | A1 | 11/2013 | Bar-Tal et al. | |
| 2014/0026769 | A1 | 1/2014 | Miller | |
| 2014/0118453 | A1 | 5/2014 | Onodera et al. | |
| 2015/0151551 | A1 | 6/2015 | Livingston | |
| 2015/0273866 | A1 | 10/2015 | Sakai | |
| 2016/0129707 | A1* | 5/2016 | Kojima | B65H 43/08 347/16 |
| 2017/0182717 | A1 | 6/2017 | Byun et al. | |
| 2017/0210403 | A1* | 7/2017 | Mattioli | G01C 7/04 |
| 2017/0253022 | A1* | 9/2017 | Henn | B41J 13/223 |
| 2017/0320316 | A1 | 11/2017 | Nakamura et al. | |
| 2017/0320339 | A1 | 11/2017 | Matsumoto et al. | |
| 2018/0106608 | A1* | 4/2018 | Hibi | G06T 7/60 |
| 2018/0345691 | A1 | 12/2018 | Kunioka | |
| 2020/0122463 | A1 | 4/2020 | Ben-Zur et al. | |

FOREIGN PATENT DOCUMENTS

| | | |
|---|---|---|
| CN | 102431326 | 5/2012 |
| CN | 103507415 | 1/2014 |
| CN | 203805511 | 9/2014 |
| CN | 205768058 | 12/2016 |
| CN | 107074259 | 8/2017 |
| CN | 107150509 | 9/2017 |
| DE | 4023411 | 2/1992 |
| DE | 102016224975 | 6/2018 |
| EP | 3170666 | 5/2017 |
| JP | 2018-144263 | 9/2018 |
| WO | WO 2020/129065 | 6/2020 |

OTHER PUBLICATIONS

Notice of Allowance dated May 14, 2020 from the US Patent and Trademark Office Re. U.S. Appl. No. 29/674,176. (6 pages).

Official Action dated Feb. 6, 2020 From the US Patent and Trademark Office Re. U.S. Appl. No. 29/674,176. (13 pages).

Kornit "Kornit Digital Launches the Atlas", Retrieved from meprinter.com, 2 Pages, Jan. 22, 2019.

Notification of Office Action and Search Report dated Mar. 18, 2021 From the State Intellectual Property Office of the People's Republic of China Re. Application No. 201980009114.3 and Its Translation of Office Action Into English. (17 Pages).

International Preliminary Report on Patentability dated Jul. 1, 2021 From the International Bureau of WIPO Re. Application No. PCT/IL2019/051389. (7 Pages).

Supplementary European Search Report and the European Search Opinion dated Jun. 30, 2021 From the European Patent Office Re. Application No. 19897528.6. (7 Pages).

Notification of Office Action and Search Report dated Sep. 17, 2021 From the State Intellectual Property Office of the People's Republic of China Re. Application No. 201980009114.3. (8 Pages).

Translation Dated Oct. 7, 2021 of Notification of Office Action dated Sep. 17, 2021 From the State Intellectual Property' Office of the People's Republic of China Re. Application No. 201980009114.3. (7 Pages).

Decison of Rejection dated Jul. 27, 2022 From the State Intellectual Propertv Office of the People's Republic of China Re. Application No. 201980009114.3. (6 Pages).

Decison of Rejection dated Jul. 27, 2022 From the State Intellectual Propertv Office of the People's Republic of China Re. Application No. 201980009114.3 and its English Summary. (6 Pages).

English Translation Dated Mar. 27, 2022 of Notification of Office Action and Search Report dated Feb. 23, 2022 From the State Intellectual Property Office of the People's Republic of China Re. Application No. 201980009114.3. 9 Pages).

Notification of Office Action and Search Report dated Feb. 23, 2022 From the State Intellectual Property Office of the People's Republic of China Re. Application No. 201980009114.3. (12 Pages).

English Summary dated Aug. 12, 2022 of Decison of Rejection dated Jul. 27, 2022 From the State Intellectual Property Office of the People's Republic of China Re. Application No. 201980009114.3. (3 Pages).

* cited by examiner

PRINTING HEAD HEIGHT CONTROL

RELATED APPLICATIONS

This application is a Continuation of PCT Patent Application No. PCT/IL2019/051389 filed on Dec. 19, 2019, which claims the benefit of priority under 35 USC § 119(e) of U.S. Provisional Patent Application No. 62/782,353 filed on Dec. 20, 2018. The contents of the above applications are all incorporated by reference as if fully set forth herein in their entirety.

FIELD AND BACKGROUND OF THE INVENTION

The present invention, in some embodiments thereof, relates to printing head height control and, more particularly, but not exclusively, to measurement and control of the printing head height over a textile substrate, particularly in direct to garment printing.

In the current art, control of the print head height for a given print medium height is defined, either manually or using an offline measuring device, by the printer operator as part of the predefined data of the print job. This method has many weaknesses and limitations and is very sensitive to human error, such as inaccurate input, which may reduce the overall print quality. Furthermore, even if the initial measurements are perfectly accurate, changes in the media height during the process may render the initial measurements invalid. Such changes may be due to mechanical interference—say the medium has creases or otherwise refuses to lie flat, or there may be variance in the nature of the medium, say strands or hairs sticking out from the medium, and such issues may cause contact between the nozzles of the print head and the medium itself, or the printing surface may not be exactly flat. Such contact may impede the jet of ink from the nozzle and lead to the failed jet drying on the nozzle and causing complete or partial blockage. While print heads may be designed to compensate for small numbers of known failed nozzles, the process inevitably affects more and more nozzles as time passes, shortening the lifetime of the print head and leading to increased downtime.

A known method to detect non-uniformities in the media and protect the system against collisions between the media and the printheads, is by using a laser beam in a single dimension and arranged parallel to the media. Once the media height exceeds a preset maximum limit, the system detects the interference and typically stops the sequence immediately, with all the associated disadvantages of slowing down processing. This way the collision is avoided, but the entire printing sequence is compromised since the printer stops the job mid-flow. The current print operation is rendered waste material since it is not possible to restart the printing operation at exactly the point it was interrupted. The operator needs to intervene, reset the system and restart the job, and valuable time is lost.

Currently, measuring the media height is based on offline tools and the measurement is offline and prior to the print sequence. Instead of actual measurements, manual estimations may be used or tables may be consulted for the particular media. With some machines it is possible to program in the type of media and the machine may use a look-up table to set the head height. Current methods are thus sensitive to user's errors and to variations in the media. The end result is reduced quality due to inaccurate print height or uneven surface and the current solutions do nothing to prevent collisions with the head due to unevenness in the media.

To detect wrinkles in the media there are current solutions based on mechanical modules that detect an approaching fold in the medium. In other solutions, a laser beam crosses in front of the printing area and may also detect an approaching fold.

The detector is set to a predefined value, which usually cannot be adjusted due to the binary nature of the concept, and scans the media in front of the print heads, before or during the print sequence, to sense possible bumps or folds in the media that may endanger the print heads. When such a disturbance is detected the print sequence is stopped to avoid the danger of collision between the media and the print heads or other parts of the system. The process is based on a go/no-go filter, that is either the media is below or above the maximum allowed value, and if above, interferes with the print sequence. The process is not flexible and does not respond to changes over the course of a print job and can harm the overall user experience and availability of the system.

In the DTG (direct to garment) industry, while printing with inkjet directly on garment it is thus essential to avoid physical contact of the print heads and the garment itself in order to avoid damaging the print head. While hovering above the garment, for drop placement, with a speed that can reach 1.0 m/s, physical contact with the garment can cause damage to the very expensive print heads, which in some cases may be compensated for but is generally irrecoverable.

In the DTG industry the mean time between failures (MTBF) of the system has significant value for the customer, and a "head strike" can cause significant machine down time and a long time to repair.

One of the main reasons for the head strike is garment misplacement with a "wrinkle" that is thicker than the gap between the print head and the garment itself. The gap between the print heads and the garment is preset before the print. Since there is vast variety of garment types, the print height is adjusted accordingly.

However in addition to wrinkles, there may be variation in the height of the print media that may not be enough to strike the print head, but may still alter the distance between the medium and the print head. Since there is relative motion between the print head and the medium the ink jet follows a ballistic trajectory and if the height between the medium and the print head varies then the ink jet will not land at the intended location, leading to a reduction in print quality. Thus it is desirable to keep the distance between the print head and the print medium as close to constant as possible over the course of the printing process, however there is no way in the current art that allows this if the height of the print medium changes.

SUMMARY OF THE INVENTION

The present embodiments relate to a means of adjusting the print head height for the printing operation based on measurements taken of the medium during the course of the printing operation and then during the course of printing using the same apparatus to detect wrinkles and other anomalies that may endanger the print heads.

The thickness and wrinkle detection system may measure the thickness of the media to be printed prior to printing and set the printer height accordingly. The detection system may continue to detect anomalies and changes in thickness on the garment along with the printer workflow, without requiring any additional time for the detection process, and the detection is made prior to the printing operation on any part of the garment. If a wrinkle has been detected the print process is postponed, and the user is notified regarding the misalignment of the garment. Once the garment's placement is corrected, and sent back to print, the garment is sent for wrinkle detection again to ensure that the garment is safe to print on. Only if it is safe, the print continues exactly from the point it has stopped. The wrinkles and changes in thickness may be detected by the same measurement, as discussed, which may involve a laser curtain that detects an upper surface profile of the approaching garment, the profile being repeatedly taken over a finite distance of the advancing garment, typically of the order of magnitude of 25-30 mm.

According to an aspect of some embodiments of the present invention there is provided a digital textile printing device comprising:

a print head;

a printing surface configured to feed a medium for printing in a feed direction that passes the print head for printing;

a measurement unit arranged downstream of the print head in the feed direction to measure a thickness of the medium for printing, the measurement unit configured to measure the thickness over a finite length in the feed direction of the printing medium towards the print head.

In an embodiment, the measurement unit is configured to take a plurality of thickness measurements over the finite length.

In an embodiment, the measurement unit is configured to take the measurements repeatedly over a printing duration.

In an embodiment, the measurement unit comprises a laser emitter and a laser collector.

In an embodiment, the measurement unit produces a laser curtain extending up to a predetermined thickness over the finite length to measure a height profile of the textile.

In an embodiment, the print head has an adjustable height and a controller for controlling the height and wherein the controller is responsive to the measurement unit to adjust the height according to a measured thickness of approaching print media.

In an embodiment, the controller is responsive to measured thicknesses within a predetermined range to carry out the height adjustment, and to halt printing when the measured thickness is outside the predetermined range.

In an embodiment, the controller is configured to return the printing surface for readjustment when the measured thickness is outside the predetermined range, then to repeat the measurement and if within the predetermined range to resume printing.

In an embodiment, the measurement unit is located alongside a preprinting treatment unit in the feed direction to the printer.

In an embodiment, the printer is a direct to garment printer and the printing medium is a garment.

According to a second aspect of the present invention there is provided a method of digital textile printing comprising:

placing media to be printed on a print table;

feeding the media towards a print head for printing;

over a finite length of the textile approaching the print head measuring an extent of the textile towards the print head in a thickness direction of the textile;

adjusting the print head to define a predetermined printing distance between the print head and the textile for the printing; and during printing, if the extent reaches or exceeds the predetermined printing distance then pausing the printing.

In an embodiment, the measuring comprises taking a plurality of thickness measurements over the finite length.

In an embodiment, the measuring comprises taking the measurements repeatedly over a printing duration.

In an embodiment, the measuring comprises shining laser beams across the textile.

In an embodiment, the measuring comprises providing a laser curtain extending up to a predetermined thickness over the finite length.

Embodiments may involve returning the printing table for readjustment when the measured thickness reaches or exceeds the predetermined printing distance, then repeating the measurement and if within the predetermined printing distance resuming the printing.

Embodiments may involve carrying out the measuring alongside pretreating of the textile in the feed direction to the print head.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
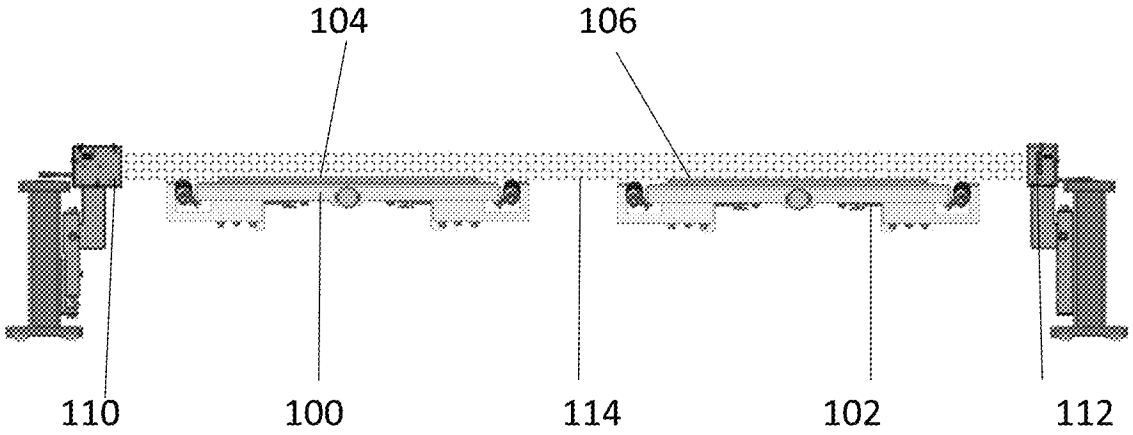
FIG. 1 is a simplified diagram showing a laser curtain extending across two printing tables according to an embodiment of the present invention.

The present invention, in some embodiments thereof, relates to printing head height control based on measurement and, more particularly, but not exclusively, to control of the printing head height over a textile substrate based on measurement.

It is noted that the material that is printed on is referred to generically as media, but may more specifically be textile and more specifically than that may be a garment, and herein the associated terms are used interchangeably.

The present embodiments may involve placing a textile to be printed on a print table and feeding towards a print head. A finite length of the textile approaching the print head is measured for thickness in the upward direction, that is facing the print head. Then, if the extent is within a predetermined range the height of the print head is adjusted to maintain a predetermined printing distance. During the course of printing, measurement continues and if the thickness extent is outside the predetermined range then it is assumed that wrinkles are present and printing is paused for readjustment of the textile.

The system of the present embodiments treats the print heads as the subject of control of height based on measurements taken of the print medium. A single measurement routine or set of measurements from a measurement source may address both the issues of print media height and correct positioning of the print heads and the presence of wrinkles. The measuring routine may detect the height of the media inline with the printing process and on a repeated or continuous basis during the printing process. The measurement results may be used to correct the print height prior to printing. In a specific embodiment the print height may also be adjusted in real time during printing if the height changes, meaning that the media approaches the print head at a typical media feed speed and the print head is set at the correct height as the media arrives. Measurement is carried out on-the-fly and irrespective of whether the print heads are moved, in cases where the media thickness extends into the safety margin of the print head, e.g. by a wrinkle in the garment—the routine pauses the current printing, returns the media to the operator and allows him to correct the problem and maintain the current job. The correction may have minimal effect on the overall printing operation.

In an embodiment, a laser curtain is used as a measurement component. A series of laser beams extend perpendicularly across the feed direction of the media, and form a rectangle or like shape having a finite length and preset height, along the approaching textile and obtain a profile of the textile surface within the rectangle, the textile being along the feed direction. A laser curtain is particularly suitable for finding a maximum height over the surface of an area of material. The laser curtain may thus make a measurement of the profile, wherein small deviations are fed in to change the height of the print heads, and large changes may cause the printing to be stopped temporarily. The measurement is executed along with printer's workflow to detect misplacement (wrinkles) that eventually can cause a head strike on DTG printers.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, reference is firstly made to FIG. 1, which is a simplified diagram showing a section across the print feed direction of a printing table and laser curtain according to an embodiment of the present invention. Two side by side printing tables 100 and 102 carry respective print mediums 104 and 106 towards a print head 108 (FIG. 2) for printing. The printing tables pass in the gap between a laser emitter 110 and a laser collector 112. A lengthwise extending laser curtain 114 extends over a finite length in the feed direction approaching the print head.

Figure 2:
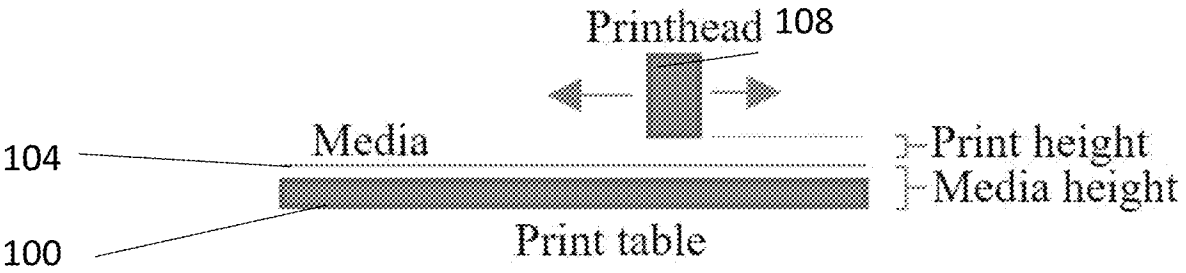
FIG. 2 is a simplified longitudinal cross-section showing the printing table passing a print head according to embodiments of the present invention.

FIG. 2 is a longitudinal cross-section showing the print head 108. Print head 108 moves back and forth over the print table 100 over the top of media 104. The print head is mounted at a height above the print table and that height comprises the height of the media plus a certain predetermined print height.

Thus the digital textile printing device may be a direct to garment digital printer with pre and/or post processing and may print using black and white or three, four, and five or more color systems. The printer may include print head 108, one or more printing surfaces such as the twin print tables or pallets 100 and 102 shown in FIG. 1. The surfaces are mobile to feed, media in a feed direction past the print head for printing.

The measurement unit, made up of emitter 110 and collector 112 as shown in FIG. 1, is located upstream in the feed direction relative to the print head and extends perpendicularly across the feed direction (see FIG. 6) to measure a media height of the printing medium over a finite length (see FIG. 6) in the feed direction to obtain a profile. The measurement may be of the upper extent of the textile in the thickness direction towards the print head. To provide measurements over a finite length rather than across a single line, the measurement unit may take multiple thickness measurements over the finite length. The measurement unit may take the measurements repeatedly over a printing duration so that the advancing textile surface approaching the print head is measured prior to approach. In an embodiment, the measurement unit comprises a laser emitter and a laser collector and multiple laser beams are shone across the top of the print media surface over the finite length to detect the profile.

In a particular embodiment, the measurement unit comprises a laser curtain extending up to a predetermined thickness over the finite length so that both a finite length and a finite height along the finite length are measured, hence the use of the term curtain.

The embedded inline laser curtain has two main functionalities in the Direct to Garment (DTG) printers:

1) Automatic print height setting

The first function is automatic setting of the height of the print heads. The function involves measuring the actual height of the media before starting the print routine. In certain embodiments, function includes continually remeasuring and defining the optimal height of the printheads above it during printing. Such continual print height setting may guarantee the best print quality since there is sensitivity to changes in the media. Furthermore, the operator may change the medium on the printer without needing to stop the sequence for offline measurements and calibrations. Furthermore, it is possible to print on a medium where the thickness changes abruptly, say a shirt having a pocket. In other embodiments continual measurement during printing is only to stop the printing if wrinkles or thickness variations are detected—see the second function below.

2) Wrinkle detection and avoidance of head strikes

Figure 3:
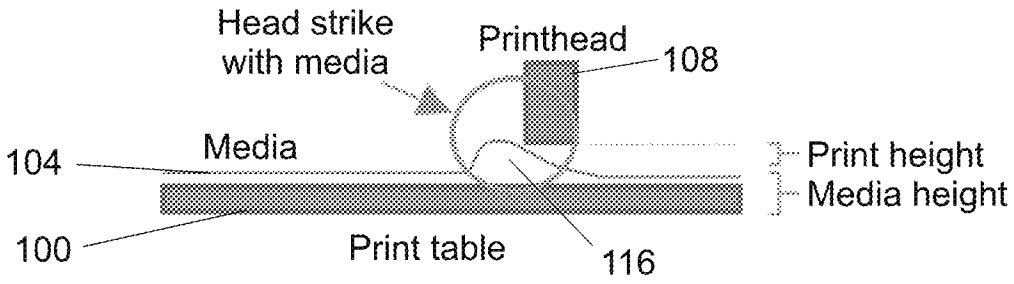
FIG. 3 is the section of FIG. 2 where a wrinkle has got into the print media.

The second function is automatic detection of wrinkles. The same measurement may detect interference in the media level, e.g. wrinkles in the fabric caused by human error in placement of the medium, or system malfunctions such as a gripping component accidentally coming loose, or the like. If such a wrinkle is detected then the function may serve to pause the current print for a few seconds to allow the operator to correct the problem without affecting the job's integrity. A reason the present embodiments are able to stop, wait for the operator to carry out smoothing and then continue is that the laser curtain of the present embodiments is able to remeasure the whole area after smoothing, rather than just a single line, and check that the problem is solved. Reference is now made to FIG. 3, which is the same view as in FIG. 2 but with a wrinkle 116 introduced into the medium. Remaining parts of the Figure are given the same reference numerals as in FIG. 2 and are not described again except as needed for an understanding of the wrinkle function. In FIG. 3 wrinkle 116 reaches right through the print height from the media height and if the print head 108 is to reach the wrinkle then material of the wrinkle may block nozzles on the print head, causing damage as described above.

The wrinkle detection function may serve to avoid head strike, hence improving the system's uptime, that is its availability for printing, as well as saving direct and indirect costs of damaged print heads and improving the overall lifetime of the print head.

Figure 4:
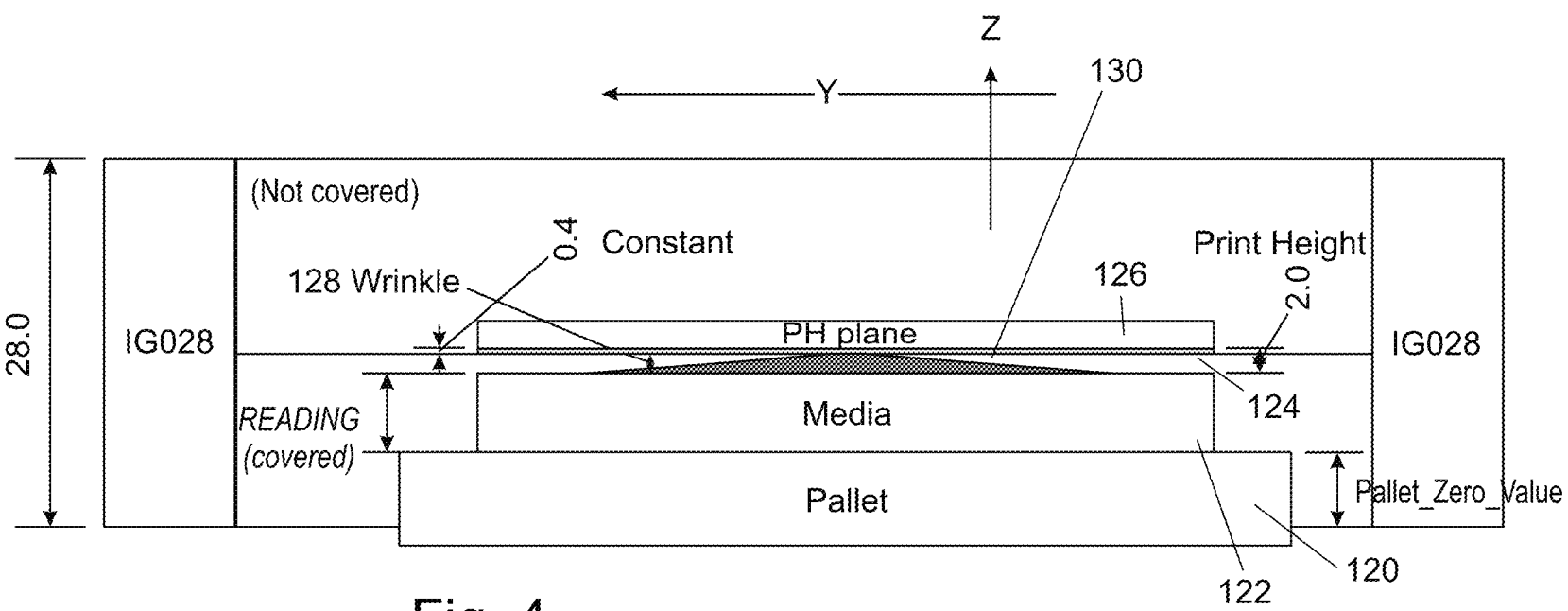
FIG. 4 is a view of a section passing a print head and showing the various height ranges according to embodiments of the present invention.

Reference is now made to FIG. 4, which is a simplified transverse cross section showing rectangles or planes which may be measured by the laser curtain. In FIG. 4, the pallet plane is indicated by 120. The plane of the medium is 122. The plane of the print height is 124 and the plane in which the print head moves is 126. It is noted that the present embodiments may take into account the pallet zero value of the printing table. This has the advantage that the user is free to use customized printing tables rather than those provided and does not need to make sure that the customized tables match exactly with those provided or even with each other.

Exemplary values for the different plane sizes are shown in FIG. 4 in millimeters. Thus the print height 124, the height between the media and the print head may be 2 mm. The wrinkle 128 is required to leave a safety space 130 of 0.4 mm under the print head. That is to say small wrinkles of up to 1.6 mm in height are tolerated.

Figure 5:
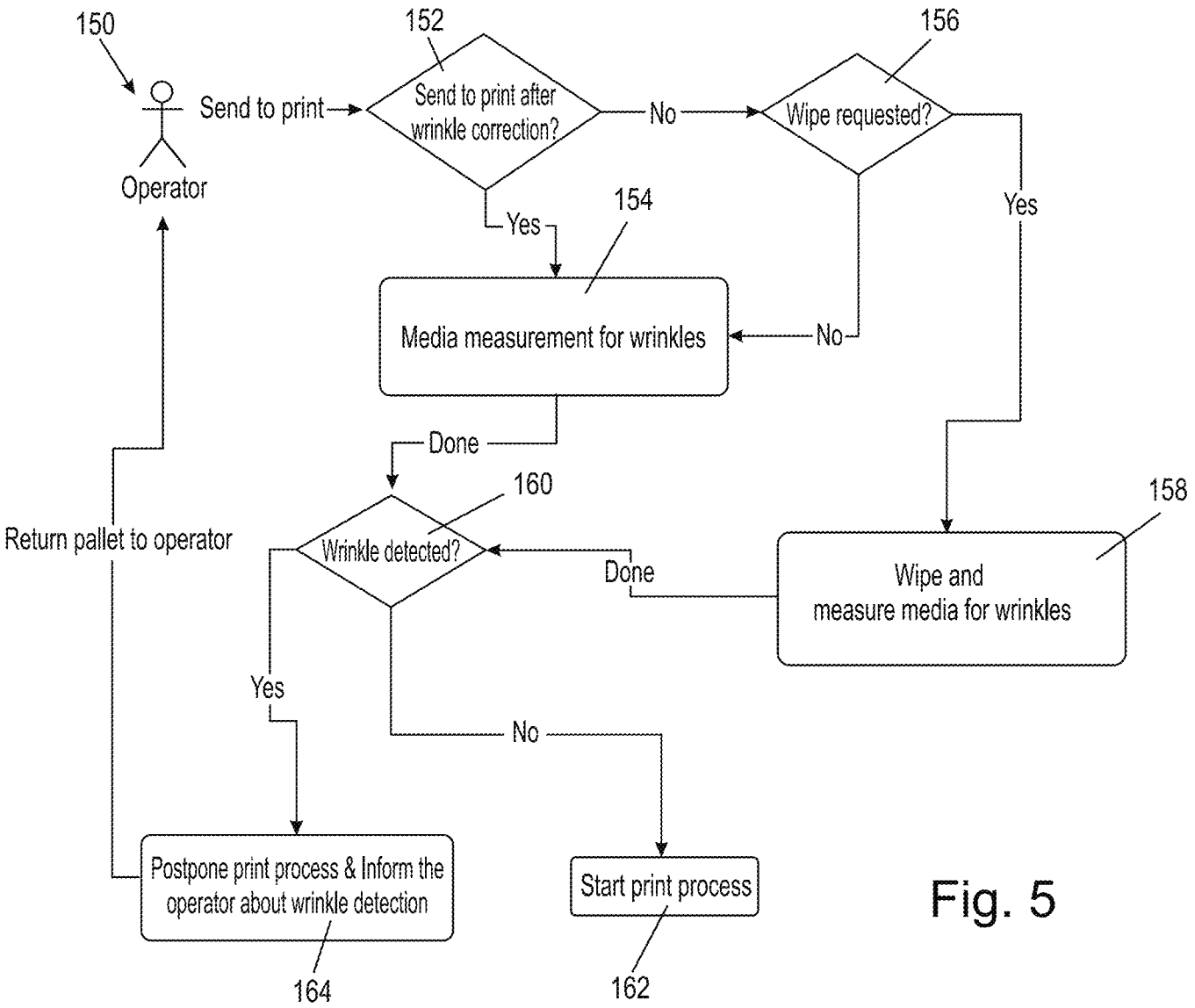
FIG. 5 is a simplified flow chart showing the procedure for modifying the print process when a wrinkle is detected according to embodiments of the present invention.

Reference is now made to FIG. 5, which is a simplified flow chart showing the procedure for detecting and then safely processing wrinkles, and the present embodiments may be used for wrinkle detection without control of the print head height, or vice versa with control of the print head height and without wrinkle protection, and FIG. 5 shows the procedure after the print height has already been set by an initial measurement. Operator 150 sends the current print job for printing. Box 152 determines whether the current print job has already been subject to wrinkle detection. If yes then flow proceeds to box 154 which tests again for wrinkles. If not then the system determines whether wiping or other pre-printing processing has been requested—box 156. If not then flow proceeds to box 154 as before. If the answer is yes then flow proceeds to block 158 where measurement and preprocessing such as wiping are carried out together. It is advantageous to carry out the measurement along with and just after the wiping because wiping, along with other pre-treatments may affect the thickness being measured and in extreme cases may even be the cause of wrinkles.

In box 160 it is determined whether a wrinkle has been detected. If no wrinkle is detected then flow proceeds to box 162 and printing proceeds or continues. If on the other hand box 160 determines that a wrinkle is detected, then flow proceeds to box 164, printing is postponed and the pallet is returned to the operator for smoothing.

The automatic height measurement as described herein may be embedded in direct to garment (DTG) printers. The system may be installed in the printer and may do at least one of the following or continuously:

(a) measure the media height and define the print height in real-time;

(b) measure the flatness of the printing tables and notify the user of any misalignment or uneven table and avoid reduction in the print quality; and (c) detect uneven surface of the media (e.g. wrinkles in the fabric) and avoid collisions with the print heads.

The present embodiments may thus measure the garment thickness with a laser device, the measurement being made along with the wiping or any other inline pre-treatment process. The embodiments may notify in real time when the thickness exceeds the permitted safe thickness. Thus a head strike may be prevented before the actual print take place. In the above an example was given in which pre-treatment was avoided if the medium had previously been treated and was being refed after wrinkle detection. It is noted that pre-treatment may be dispensed in all cases simply by not requesting wipe in box 156, so that flow proceeds directly to wrinkle detection.

Figure 6:
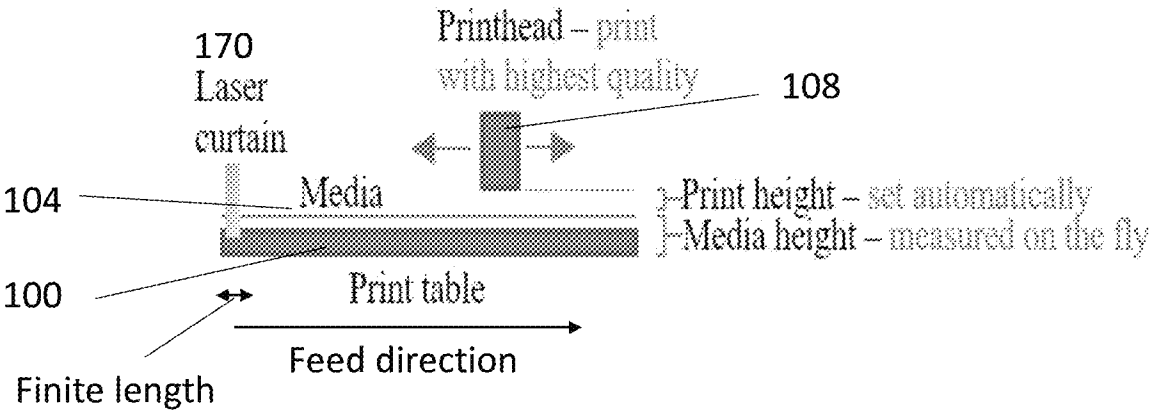
FIG. 6 is the section of FIG. 2 showing the addition of a laser curtain for measuring according to embodiments of the present invention.

Reference is now made to FIG. 6, which illustrates the use of a laser curtain. Parts that are the same as in FIGS. 2 and 3 are given the same reference numerals and are not described again except as needed for the present explanation. Laser curtain 170 extends for a finite length along the feed direction of media 104 towards print head 108, and for a finite height to give a lengthwise profile of the upper surface of the garment. The height of the printing table is not measured directly during the print process—although it may be measured in advance, but variations in the printing table height are picked up as changes in the media thickness. The media height is measured on an ongoing basis. The print height is set in advance and is kept constant in the face of variations in media height.

The use of the laser curtain, with analog signal input to the controller of the printer, allows a length across an area of material along which the profile is measured. Typical lengths are between 20 mm and 40 mm or between 25 mm and 30 mm, and in an exemplary embodiment the length is 28 mm. The detection algorithm may be adjusted for various garments.

The following parameters may be defined for the system:

Reading—The real time analog reading received from the laser device.

Pallet_Zero_Value—The value that is measured on the bare pallet (printing plate) without any garment, say when a pallet is replaced or when such a measurement is initiated proactively.

PresetMedia—garment thickness that is preset by the user for the current printing job.

PresetPrintHeight—The print height above the printed garment that is preset by the user for the printing job.

Constant—a constant clearance gap between the print heads and the measured media.

A wrinkle may be detected while the system performs the wiping or other pretreatment procedure as discussed in respect of FIG. 5, or a dedicated measurement may be carried out if no pretreatment is being applied.

Exemplary wiping profile settings are Velocity—0.250 m/s, and the pallet may vary between a standard pallet height of 50 mm, and say a maximum pallet height of 90 mm, typically starting with a preset, which is followed by adjustments during the course of printing.

Figure 7:
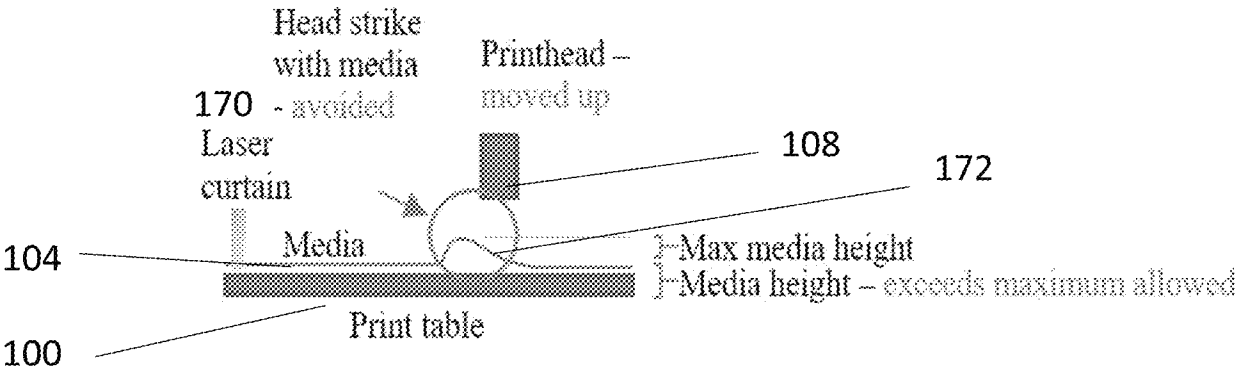
FIG. 7 is the section of FIG. 6, where a wrinkle has got into the print media.

Reference is now made to FIG. 7, which is a variation of the view shown in FIG. 6. Parts that are the same as in FIG. 6 are given the same reference numerals and are not explained again except as needed for an understanding of the present embodiment. In this case, laser curtain 170 has detected a wrinkle 172. In this case, unlike in FIG. 3, the wrinkle does not exceed the maximum media height. Thus print head 108 is simply moved upwards to ensure the correct print height over the wrinkle. Printing continues.

Figure 8:
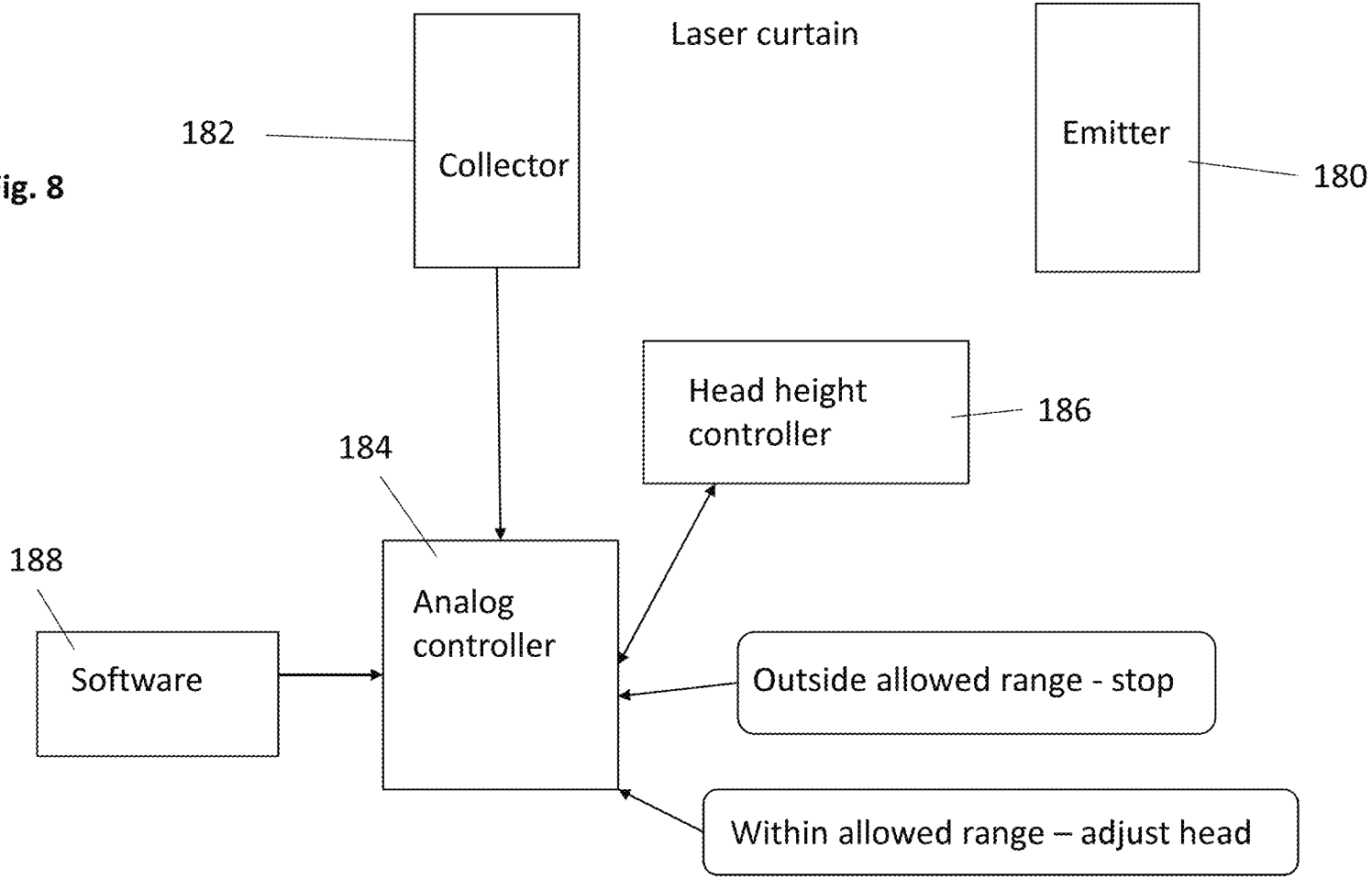
FIG. 8 is a simplified schematic diagram showing details of the control system for a printing machine according to the present embodiments.

Reference is now made to FIG. 8, which is a simplified block diagram showing operation of an embodiment of the present invention. A laser curtain is formed between laser emitter 180 and collector 182, enabling detection of a media thickness or upper surface profile within the range of the curtain. Analog controller 184 operates a head height controller 186 and is in turn controlled by system software 188. The control system may ensure that if the measurement from the laser curtain is within a preset range then the head height is adjusted by head height controller 186 to keep the print height constant. If the measurement is outside the range then printing is temporarily halted.

Thus, the print head has an adjustable height, and a controller, formed of the combination of software 188, analog controller 184 and head height controller 186, adjusts the height of the print head based on the measured changes in thickness of the approaching print media. If the measured thickness is within a predetermined range then head height adjustment is carried out. However if the measured thickness is outside the range, the controller may halt printing.

As discussed in respect of FIG. 5, the controller returns the printing table for readjustment by the operator when the measured thickness is outside the predetermined range. After readjustment, the printing table is advanced again to repeat the measurement and, if within the predetermined range, printing is resumed. If the measurement is outside the range then the printing table is returned again.

As discussed, the measurement unit may be located alongside a preprinting treatment unit, so that the measurement includes any effects of the pretreatment.

If the printer is a direct to garment printer, then the printing medium is a garment.

The laser device, laser emitter and laser collector, may conveniently be mounted in horizontal manner inside the body of the printer to allow:

Easy calibration of the laser beam for alignment;

The ability of the laser to detect any possible wrinkle;

The ability to measure the pallet with and without garment, just after wiping; and Signal integrity when pallets are not in position;

A correct preset of media (garment) thickness is useful for defining the print head initial height above the media during the printing operation.

Accurate height and flatness of the media may help in defining the optimal printing height for the required print quality that is in registration and may help to avoid print head strike as discussed. The print height above the media may be preset manually and may also be verified manually by moving the printing plate with the garment, offline, beneath the printing heads, and visually inspected for collision.

By using the embedded laser curtain and associated software, the system may measure the thickness of the garment, especially on the printing area. Test embodiments have achieved a resolution of 0.1 mm.

The maximal value of the media thickness may be measured through the entire garment, regardless of the image printing area. Having such a maximal thickness value of the garment in advance means that the user does not have to himself manually inspect for collision. Rather the option for choosing those preset values of print height that may cause collision are disabled. The user is only permitted to preset safe print height values.

To improve the quality of the printed image, the laser curtain may validate the media thickness during the pretreatment procedure. The media is scanned through the image area for the actual media thickness, and through the entire media for maximal thickness value.

Figure 9:
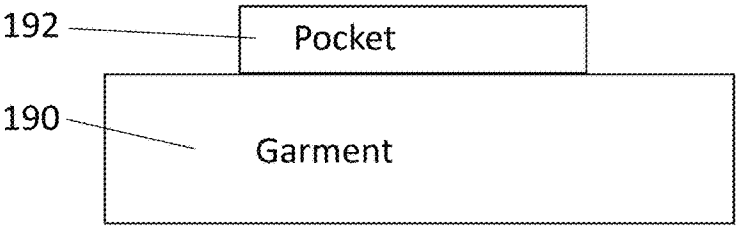
FIG. 9 is a simplified diagram showing the use case of a garment with a pocket, where the present embodiments may print such a garment.

The print height may then be automatically adjusted to meet the preset media and print height, and in certain embodiments may be subsequently adjusted to take into consideration the maximal measured value, thus avoiding collisions and maintaining the desired printing height. Referring now to FIG. 9, a case is shown of a garment 190 having two different heights, a background height, and an increased height where a pocket 192 has been sewn on. The present embodiments allow for single pass printing where the print head is automatically adjusted when reaching the pocket.

Figure 10:
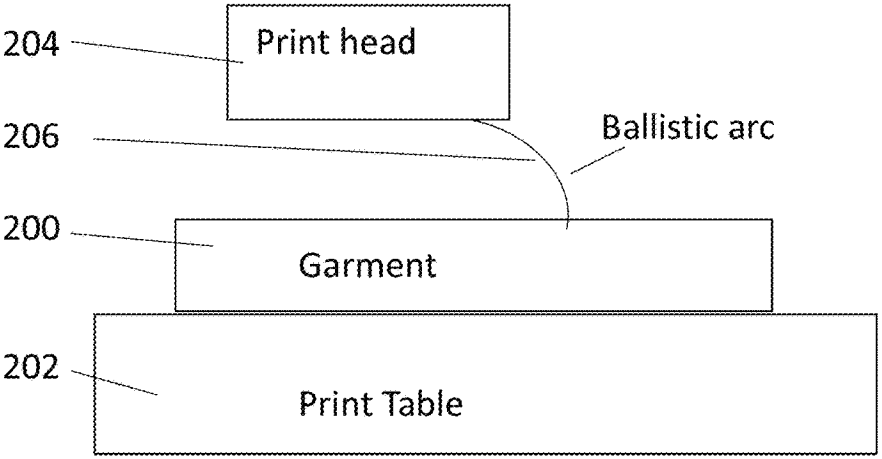
FIG. 10 is a simplified diagram schematically illustrating the ballistic arc taken by an inkjet drop and providing a reason for keeping the printing height constant.

Reference is now made to FIG. 10 which illustrates the operation of a print head according to the present embodiments and demonstrates the requirement for a constant or substantially constant print height for textile printing.

As shown in FIG. 10, garment 200 is on print table 202 and print head 204 is located a preset distance from the garment. During printing the print head typically travels from one side of the garment to the other. In some machines the print head may be stationary but the print tray may be moving. Thus ink jet 206 emitted from the print head follows a ballistic trajectory from the nozzle to the garment. Now the position that the ink jet lands on the garment is fixed if the print head speed and the print height are both fixed. However as soon as the print height starts to vary, the part of the ballistic arc at which the jet hits the garment changes and thus the position ceases to be predictable. Hence variation in the print height leads to loss of print quality and hence the attempts of the present embodiments to control the print head height.

Figure 11:
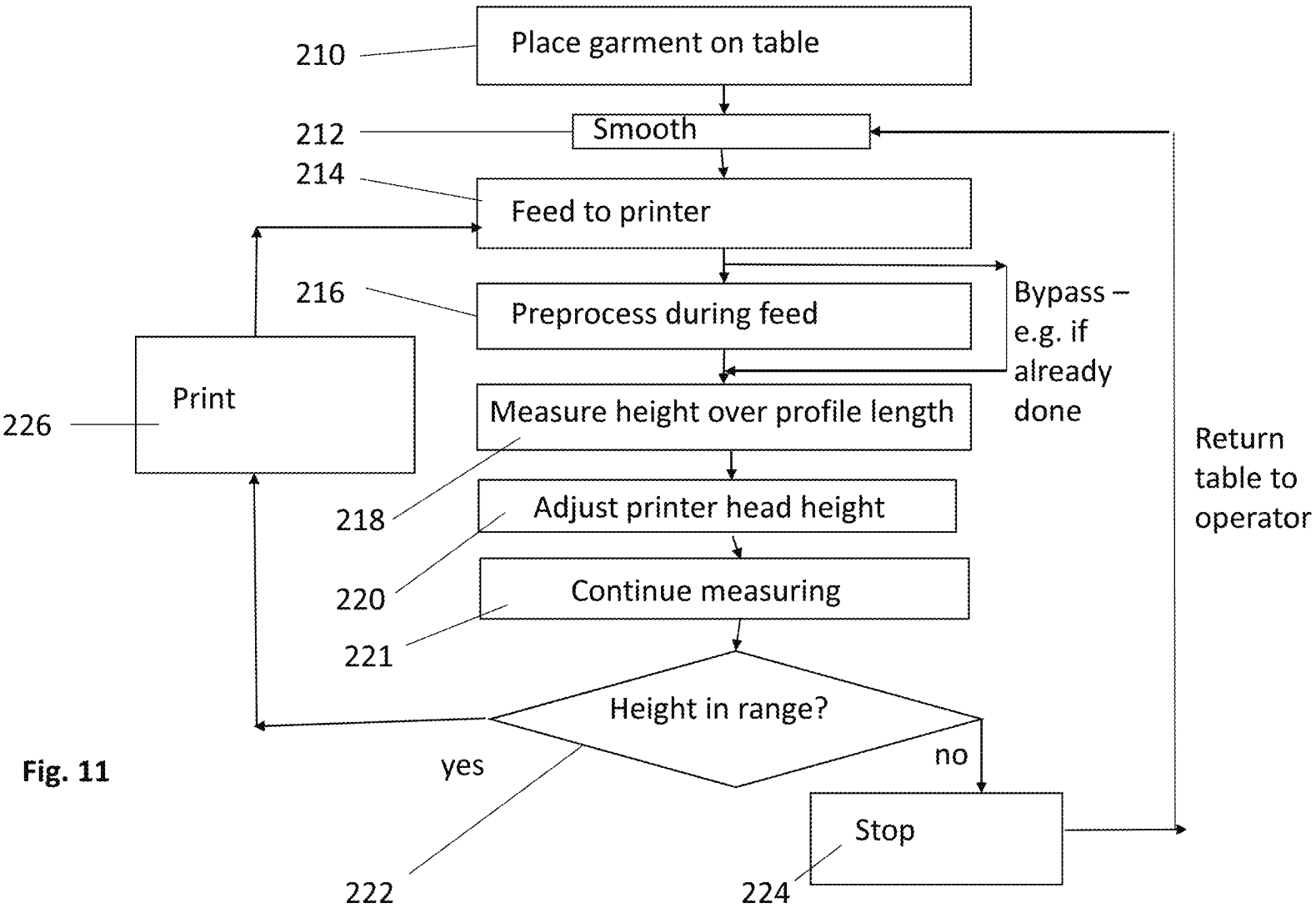
FIG. 11 is a generalized flow chart showing a printing procedure according to embodiments of the present invention.

Reference is now made to FIG. 11, which is a simplified flow chart illustrating an overall procedure for textile printing, and more particularly but not exclusively to direct to garment printing, according to embodiments of the present invention.

A textile to be printed, for example a garment, is placed on a printing surface such as a table or a tray or a pallet—box 210. The garment is optionally smoothed over the surface, typically by the operator, so that there are no wrinkles to upset the printing process—box 212.

The textile is then fed towards the print head for printing—box 214. During the feeding process, various preprocessing operations such as wetting may be carried out—216. It is noted that preprocessing should not be carried out twice on the same garment so if the currently fed garment has already undergone pre-processing, for example because it is being fed a second time following removal of wrinkles, then the preprocessing operation is bypassed. Alternatively, in embodiments, preprocessing may not be required at all.

While the textile is being fed, a finite length of the textile approaching the print head is measured for height, that is how much it extends towards the print head—218. In other words the uppermost extent of the textile towards the print head is measured over a given length, and the print height is adjusted accordingly—220. Measuring may involve taking multiple thickness measurements over the given length, and in 221, the measurements may be continued and repeatedly made over a printing duration. In embodiments measuring may involve shining laser beams across the textile surface, so that beams that are blocked indicate the presence of textile material at that thickness. In an embodiment a laser curtain provides a rectangle of laser beams extending up to a predetermined thickness over the given length so that a profile of the upper surface of the textile is obtained.

In decision box 222 the height measured is tested to see whether it is safe, in which case printing takes place 226.

If the extent is outside the predetermined range, then the procedure for dealing with wrinkles is entered. Box 224 indicates that printing is paused while the table is returned to the operator to repeat the smoothing operation 212.

Printing is carried out as the process enters box 226, and measurement continues as long as more of the garment is being fed towards the printer.

It is expected that during the life of a patent maturing from this application many relevant laser curtain and textile printing technologies will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the text is to be construed as if such a single embodiment is explicitly written out in detail. Conversely, various features of the invention, which are, for brevity, described in the context of a single embodiment, may also be provided separately or in any suitable subcombination or as suitable in any other described embodiment of the invention, and the text is to be construed as if such separate embodiments or subcombinations are explicitly set forth herein in detail.

Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A digital textile printing device comprising:

a print head;

a printing surface configured to feed a medium for printing in a feed direction that passes said print head for printing;

a measurement unit arranged downstream of said print head in said feed direction to measure a thickness profile of said medium for printing, the measurement unit configured to measure said thickness profile perpendicular to said feed direction and over a finite length in said feed direction of said printing medium towards said print head, wherein said measurement unit comprises a scanning laser transmitter and detector at respectively configurable displacements along said finite length in said feed direction and perpendicular to said feed direction said laser transmitter thereby configured to set up a two-dimensional laser curtain perpendicular to said feed direction over said finite length, the laser curtain thereby able to obtain a height side profile of said medium, wherein said print head has an adjustable height and a controller for controlling said height and wherein said controller is responsive to said measurement unit to adjust said height according to a measured thickness of approaching print media, said adjustment being made when said measured thicknesses is within a predetermined range, said controller being configured to halt printing when said measured thickness is outside said predetermined range.

2. The digital textile printing device of claim 1, wherein said measurement unit is configured to take said measurements repeatedly over a printing duration.

3. The digital textile printing device of claim 1, wherein said measurement unit comprises a laser emitter and a laser collector.

4. The digital printing device of claim 1, wherein said controller is configured to return said printing surface for readjustment when said measured thickness is outside said predetermined range, then to repeat said measurement and if within said predetermined range to resume printing.

5. The digital printing device of claim 1, wherein said measurement unit is located alongside a preprinting treatment unit in said feed direction to said printer.

6. The digital printing device of claim 1, wherein the printer is a direct to garment printer and said printing medium is a garment.

7. A method of digital textile printing comprising:

placing textile media to be printed on a print table;

feeding said textile media towards a print head for printing;

at a point over a finite length along a feed direction and a height perpendicular to said feed direction of said textile approaching said print head, projecting a laser beam to form a two-dimensional laser light curtain and measuring an extent of said textile media towards said print head in a thickness direction of said media, obtaining a thickness profile of said textile;

during printing, dynamically adjusting said print head using said thickness profile to define a predetermined printing distance between said print head and said textile for said printing; and during printing, if said extent reaches or exceeds said predetermined printing distance then pausing said printing.

8. The method of claim 7, wherein said measuring comprises taking a plurality of thickness measurements over said finite length.

9. The method of claim 7, wherein said measuring comprises taking said measurements repeatedly over a printing duration.

10. The method of claim 7, wherein said measuring comprises shining laser beams across said textile.

11. The method of claim 7, wherein said measuring comprises providing a laser curtain extending up to a predetermined thickness over said finite length.

12. The method of claim 7, comprising returning said printing table for readjustment when said measured thickness reaches or exceeds said predetermined printing distance, then repeating said measurement and if within said predetermined printing distance resuming said printing.

13. The method of claim 7, comprising carrying out said measuring alongside pretreating of said textile in said feed direction to said print head.

14. The method of claim 7, wherein said printing is direct to garment printing and said printing medium is a garment.

* * * * *